US005698129A

United States Patent [19]

Keller et al.

[11] Patent Number: 5,698,129

[45] Date of Patent: Dec. 16, 1997

[54] SLIDING GATE VALVE FOR A METALLURGICAL VESSEL

[75] Inventors: Werner Keller, Steinhausen; Walter Toaldo, Zug; Hans Müller, Steinhausen; Werner Plattner, Hünenberg; Anton Pfyl, Affoltern a.A., all of Switzerland

[73] Assignee: Stopinc AG, Baar, Switzerland

[21] Appl. No.: 604,013

[22] Filed: Feb. 20, 1996

[30] Foreign Application Priority Data

Feb. 17, 1995 [CH] Switzerland ..... 00 460/95

[51] Int. Cl.[6] ..... B22D 41/08

[52] U.S. Cl. ..... 222/600

[58] Field of Search ..... 222/591, 600

[56] References Cited

U.S. PATENT DOCUMENTS

| | | | |
|---|---|---|---|
| 4,415,103 | 11/1983 | Shapland et al. | 222/600 |
| 5,174,908 | 12/1992 | King et al. | 222/600 |
| 5,211,857 | 5/1993 | Brinker | 222/600 |
| 5,400,930 | 3/1995 | Richard | 222/600 |

FOREIGN PATENT DOCUMENTS

| | | |
|---|---|---|
| 2523928 | 10/1976 | Germany . |
| WO 94/23867 | 10/1994 | WIPO . |

*Primary Examiner*—Scott Kastler

*Attorney, Agent, or Firm*—Wenderoth, Lind & Ponack

[57] ABSTRACT

A metallurgical vessel has a refractory head piece and a vessel outlet at the refractory head piece. A sliding gate valve for this metallurgical vessel includes a housing frame that is mounted to the vessel at the outlet so as to be removable therefrom. A slider unit is mounted in the housing frame having a sliding plate therein. A refractory base plate is also mounted in the housing frame, and has an upper side with a plane sliding surface that is engaged with the refractory head piece and a lower side having a lower sliding surface that is parallel to the plane sliding surface. The sliding plate is pressed against the lower sliding surface of the refractory base plate. The refractory base plate is fixed in the housing frame in a direction parallel to the sliding surfaces of the refractory base plate, but is movable in the housing frame in a direction perpendicular to the sliding surface of the refractory base plate. Spring elements bias the sliding plate against the lower sliding surface of the refractory base plate, and the refractory base plate against the refractory head piece. By being able to easily remove the housing frame, both the refractory base plate and the sliding plate can be easily and quickly exchanged as necessary.

26 Claims, 2 Drawing Sheets

SLIDING GATE VALVE FOR A METALLURGICAL VESSEL

BACKGROUND OF THE INVENTION (1) Field of the Invention

The present invention relates to a sliding gate valve for a metallurgical vessel having a refractory base plate and a sliding plate that is pressed in a sealing manner against the refractory base plate by spring elements, the sliding plate being slidable in a longitudinal direction in a slider unit. The refractory base plate has a plane sliding surface on an upper side thereof parallel to a lower sliding surface, and is adapted to be pressed against a refractory head piece that is secured to an outlet of the metallurgical vessel.

(2) State of the Prior Art

One known sliding gate valve is disclosed in German Patent Publication DE-C2 25 23 928. The sliding gate valve disclosed in this publication is particularly suitable for a converter in which a vessel containing molten metal has a sliding gate valve unit that is preassembled with known refractory wear parts, i.e. a sliding plate, a base plate and an outlet sleeve. The preassembled sliding gate valve unit is secured by eye bolts and guide pegs to a frame that is secured to a tap of the converter. With this construction, the base plate projects from the sliding gate valve unit and is engaged in a groove in a frontmost tapping brick of a tapping spout of the converter.

With the above construction, it must be ensured that the base plate engages in the groove and that a sealed connection is produced by mortar spread between the base plate and the frontmost tapping brick. The mortar sets, whereby molten steel is prevented from running out between the base plate and the tapping brick. Otherwise, runout of the molten metal between the base plate and the tapping brick would result in the destruction of the entire sliding gate valve unit.

Because the valve plates are subjected to a relatively considerable amount of wear, and because the valve can only be completely opened and closed if the valve plates are in a satisfactory condition, the valve plates have to be regularly changed. Typically, the valve plates are worn out after a few converter pourings, for example, and must then be replaced by new valve plates. The replacement of the valve plates involves the expenditure of some effort, because the valve must be removed from the hot converter and opened, the valve plates replaced and the valves subsequently reinstalled on the tapping hole of the converter. As discussed above, during the installation it should be ensured that the connection between the base plate and the refractory tapping brick that is adjacent to it are completely sealed with mortar between them.

The published International Application WO 94/23867 discloses a generic type of sliding gate valve. In a sliding gate valve of this type, the upper surface of the base plate projecting from the valve does not engage in a groove of the tapping brick projecting from the convertor tap via a mortar connection. Rather, the upper surface of the base plate has a plane sliding surface that is parallel to the lower sliding surface, and in operation it is pressed against a refractory head piece. The refractory head piece is secured to the vessel outlet for the purpose of satisfactorily sealing the outlet. The base plate can then be removed from the convertor vessel together with the sliding plate by a certain mechanism. In its operational state, the mechanism results in the base plate being fixed to the container. However, when the base plate is removed from the container, the base plate is released and coupled with the sliding plate and removed together with the sliding plate. The mechanism disclosed therein is a complex construction, however, and is rather unsuitable for the extremely rough operation of typical steel works.

SUMMARY OF THE INVENTION

In view of the above-discussed problems with the prior art, it is an object of the prevent invention to provide a sliding gate valve of the type described above, but which has a simple and rugged construction, and which may be rapidly and easily removed from and reinstalled on a metallurgical vessel so as to insert new refractory plates into the sliding gate valve, and without impairing the operational security of the sliding gate valve.

The above-stated object of the present invention is solved in accordance with the invention by the provision of a housing frame that is arranged to be removable from a metallurgical vessel. In the housing frame, a base plate and a slider unit having a sliding plate are received. The base plate is arranged so as to be stationary in the housing frame in the direction of its sliding surfaces, but movable perpendicularly thereto.

More particularly, the object according to the present invention is achieved by the provision of a sliding gate valve for a metallurgical vessel in which the metallurgical vessel has a refractory head piece and a vessel outlet in the refractory head piece, a housing frame mounted to the vessel at the vessel outlet so as to be removable from the vessel, a slider unit mounted in the housing frame so as to be slidable in a longitudinal direction of the housing frame, the slider unit having a sliding plate therein, a refractory base plate and spring elements biasing the sliding plate against the lower sliding surface of the refractory base plate. The refractory base plate has an upper side with a plane sliding surface that is engaged with a refractory head piece and a lower side with a lower sliding surface parallel to the plane sliding surface. The refractory base plate is mounted in the housing frame so that the sliding plate is pressed against the lower sliding surface of the refractory base plate, and so that the refractory base plate is fixed in the housing frame in a direction parallel to the sliding surfaces of the refractory base plate but movable in the housing frame in a direction perpendicular to the sliding surfaces of the refractory base plate.

Guide rails are preferably mounted to the metallurgical vessel so as to extend transversely with respect to the outlet, the housing frame being mounted on the guide rails so as to be slidable thereon between a mounting and release position and an operational position. The guide rails preferably comprise two parallel L-shaped guide rails that each define an inner guide way. Each of the two parallel L-shaped guide rails has a reduced height portion thereon adjacent to the mounting and release position. The spring elements are located so as to act between the L-shaped guide rails and the housing frame, the spring elements being engageable with the reduced height portions in order to reduce stress on the spring elements. Preferably, the housing frame has support elements along the sides thereof that engage the guide rails in order to support the housing frame. The guide rails preferably also have recesses therein corresponding to the support elements, whereby the mounting and release position corresponds to the support elements of the housing frame being located at the recesses.

The metallurgical vessel preferably has an adaptor plate thereon, with the head piece being mounted in the adaptor plate. The refractory head piece has a lower flat end surface against which the plane sliding surface of the refractory base plate is pressed.

The refractory base plate is preferably mounted in a cassette, and the cassette mounted in the housing frame by a mounting connection. The mounting connection mounts the cassette so as to be fixed in the housing frame in a direction parallel to the sliding surfaces of the refractory base plate but so as to be movable in the housing frame in a direction perpendicular to the sliding surfaces of the refractory base plate. The mounting connection may comprise elongate grooves located on one of the cassette and the housing frame that extend in a direction perpendicular to the sliding surfaces of the refractory base plate and pegs located on the other of the cassette and the housing frame engaging in the elongate grooves. The mounting connection may also comprise a cam on opposite sides of the cassette and open grooves on the housing frame, the cams being engaged with the open grooves.

The adaptor plate preferably has a ring that is releasably mounted therein, the end of the ring having an abutment, and the refractory head piece being positioned in the ring. A refractory discharge sleeve extends from the ring into the metallurgical vessel, the discharge sleeve being located adjacent to the abutment of the ring.

The refractory head piece also preferably has an annular shape with an opening extending through the head piece in an opening direction, the refractory base plate being pressed and slid against the lower flat end surface of the refractory head piece in a direction transverse to the opening direction. The refractory head piece also preferably has a connecting flange thereon, a mechanism on the adaptor plate mounting the refractory head piece to the adaptor plate by the connecting flange.

With the sliding gate valve as described above and in accordance with the present invention, the sliding plate and the base plate that are arranged in the housing frame can be very simply removed from the vessel and the refractory head piece that is secured to the outlet of the vessel. New valve plates can then very easily be inserted into the housing frame and mounted on the container, practically in one working step.

With the above-described arrangement, including the two guide rails parallel to the one another provided on the metallurgical vessel supporting the support elements of the housing frame for sliding movement thereon, and the spring elements being arranged in the support elements of the housing frame, the sliding gate valve having the refractory base plate and the sliding plate disposed therein can be removed from the vessel and remounted thereon without manual engagement. Thus, an operator avoids having to manually handle the sliding gate valve that is disposed on the hot convertor.

BRIEF DESCRIPTION OF THE DRAWINGS

The present invention is described in further detail below with reference to preferred embodiments thereof and the accompanying drawing figures, in which.

DETAILED DESCRIPTION OF THE PREFERRED EMBODIMENTS

Figure 1:
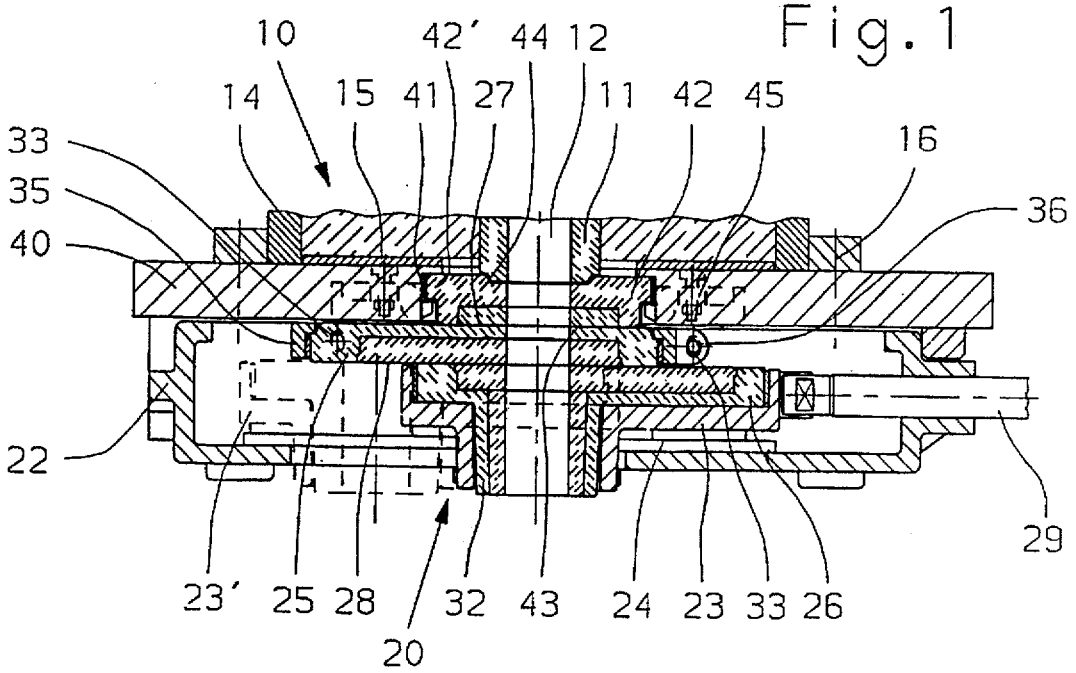
FIG. 1 is a longitudinal sectional view of a sliding gate valve in accordance with the present invention.

Referring to FIG. 1, a vessel 10 containing molten metal has a sliding gate valve 20 disposed at an outlet 12 of the vessel 10. Only a part of the vessel 10 is shown; the vessel is a convertor in which the outlet 12 is arranged not on the underside of the vessel, but in an upper region of one of the side walls of the vessel. When the vessel is tilted to be emptied, the molten metal being treated in the vessel runs out of the outlet 12, which is termed the tap.

Only a few parts of the vessel 10 are shown. An inlet sleeve 11 forming a part of the outlet 12 extends from the interior of the vessel 10 and is embedded therein. An external metallic outlet socket 14 and an end plate 15 of the vessel 10 are also shown. A flange 16 is secured to the outlet socket 14. Releasably fixed to the flange 16 is an adaptor plate 40, and the sliding gate valve 20 is securable to the adaptor plate 40. Otherwise, the vessel 10 is similar in construction to the convertor of FIG. 1 of the German Patent Publication discussed above, DE-C 25 23 928.

The sliding gate valve 20 has a housing frame 22. Inside the housing frame 22 are provided a stationary refractory base plate 25 having an upper sliding surface 27 and a parallel lower sliding surface 28. Also inside the housing frame 22 is a sliding plate 26 that is pressed against the lower sliding surface 28 in a sealing manner. A slider unit 23 holds the sliding plate 26. The slider unit 23 is longitudinally (the elongate direction of the refractory base plate 25 and the sliding plate 26) slidable in the housing frame 22 on guide rails 24 of the housing frame 22.

The slider unit 23 is moved back and forth by a drive element (not shown in detail), for example a hydraulic cylinder by a push rod 29 coupled to the drive element. The sliding gate valve 20 can then be moved into an open position as shown in FIG. 1 or into a closed position as shown by a chain line representation 23' of the slider unit 23.

Adjacent to the sliding plate 26 in the slider unit 23 is a refractory discharge sleeve 32 through which molten metal flows out and is guided into a ladle or other appropriate receiving equipment. It should be noted that controlled pouring of the outflowing molten metal is not necessary with container taps, and thus in practice the sliding gate valve adopts only either the open position or the closed position.

In accordance with a preferred feature of the present invention, the base plate 25, having its parallel surfaces 27 and 28, is disposed in the housing frame 22 so as to be stationary in the direction of the sliding surface 28, but to be movable perpendicular to the sliding surface 28. Because of this disposition of the refractory base plate 25 in the housing frame 22, the refractory base plate 25 can be resiliently pressed against the metallurgical vessel.

The metallurgical vessel has a refractory head piece 42 that is secured to the vessel outlet 12. The head piece 42, in FIG. 1, is annular and disk-shaped. At its bottom is a flat end surface 43, and a circular groove 44 is in its top end face, into which an annular formation on the discharge sleeve 11 extends. A setting mortar is preferably provided between the ends of the discharge sleeve 11 and the head piece 42. The head piece 42 further has a cylindrically shaped outer surface provided with a flange 42'. The flange 42' is positioned in an annular recess 41 in the adaptor plate 40 and fixed in the recess from below by clamping elements 45. When the sliding gate valve 20 is removed, the head piece 42 can be released and replaced. In its installed state, the lower flat end surface 43 of the head piece 42 projects slightly beyond the level of the surface of the adaptor plate 40, as shown in FIG. 1, permitting the plane sliding surface 27 on the upper side of the base plate 25 to contact the flat end surface 43. Note also that the plane sliding surface 27 projects slightly beyond the housing frame 22, so that the respective surfaces can engage each other in a sealing manner without interference.

The engagement of the plane sliding surface 27 of the base plate 25 with the lower flat end surface 43 of the head piece 42 thus forms a sealed disconnection point. Refractory base plate 25 is held in a cassette 35, which is movably held in the housing frame 22 by elongate grooves 33 (see FIG. 1) that are aligned perpendicularly to the sliding surface 28 and pegs 36 that engage the elongate grooves 33. The grooves are preferably provided on the cassette 35, and the pegs on the housing frame 22. With the arrangement of the base plate 25 in the housing frame 22 opposite to the head piece 42 on the vessel outlet 12 it is possible to remove and install the housing frame 22 together with the plates 25 and 26 and the slider unit 23 on the vessel 10.

The refractory base plate 25 and the sliding plate 26, as well as the discharge sleeve 32, may be provided in a conventional manner with respective high grade refractory inserts, for example comprising zirconia, embedded in a refractory base material. Such inserts are illustrated in the drawing figures, though not separately labelled.

Figure 2:
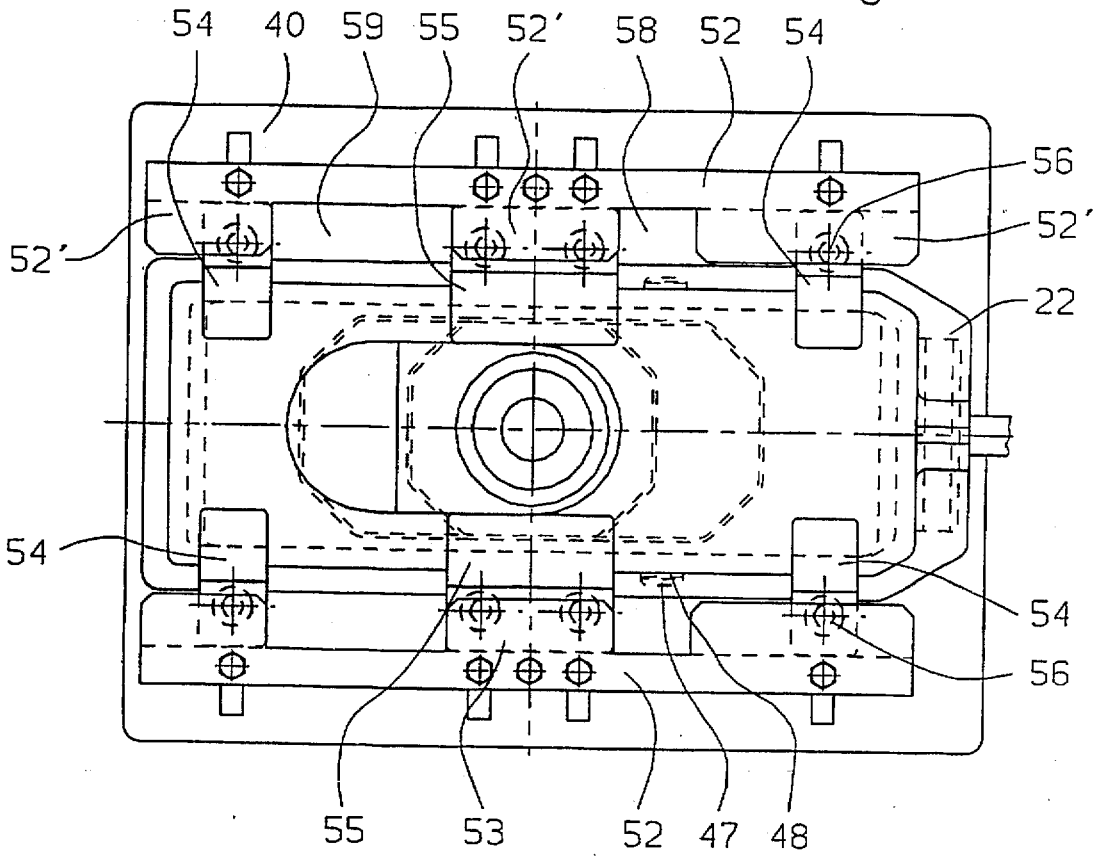
FIG. 2 is a bottom view of the sliding gate valve according to the present invention.
Figure 3:
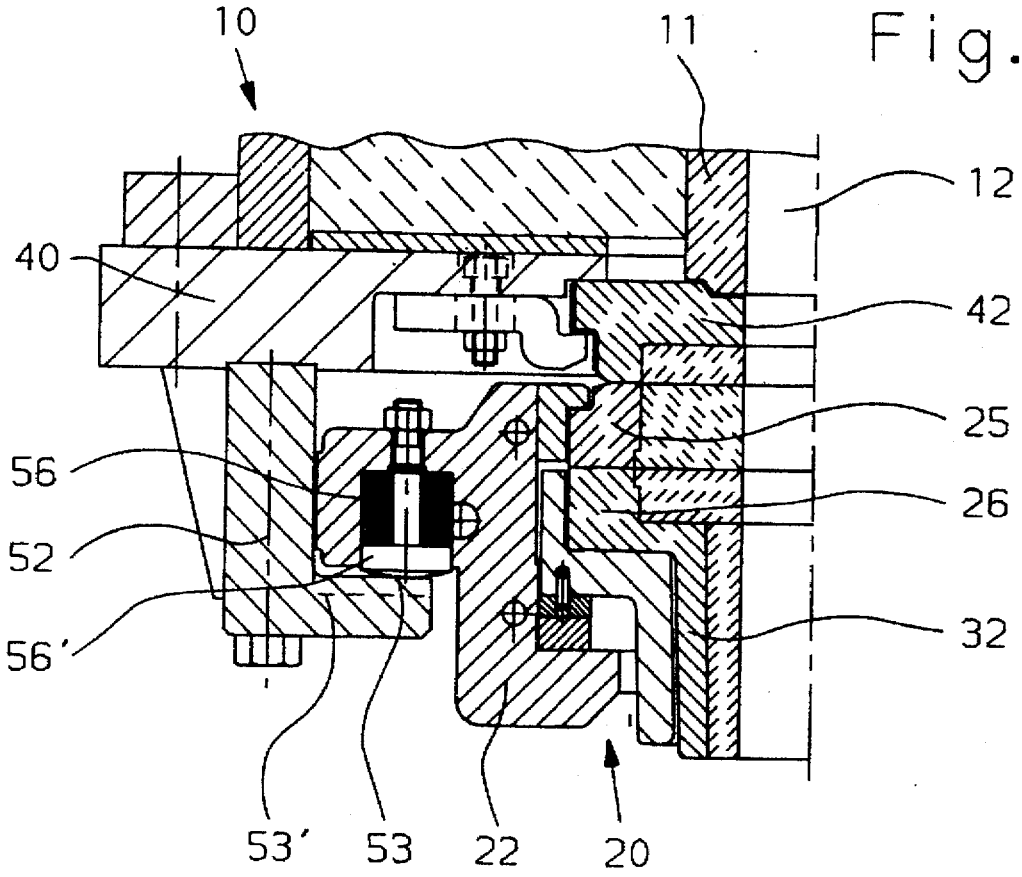
FIG. 3 is a cross-sectional view of the left half of the sliding gate valve according to the present invention looking in the sliding direction of the valve.

As shown in FIGS. 2 and 3, the adaptor plate 40, which is secured to the vessel 10 by bolts or the like, has two L-shaped guide rails 52 disposed parallel to each other, each having a respective inner guide way 53. The housing frame 22 has three support elements on each side thereof, labelled 54 and 55 in FIG. 2. The two outer support elements 54 each have one spring element 56 and the middle support element 55 has two spring elements 56. The spring elements are illustrated in FIG. 3, and each have respective guide pegs 56' pressed by plate springs.

When the housing frame 22 is installed as illustrated in FIGS. 2 and 3, the guide pegs 56' are pressed against the guide ways 53 with a force acting in a direction perpendicular to the guide ways 53. In the illustrated state of the sliding gate valve 20, there is thus a force which pushes against the guide rails 52, exerted by the spring elements 56, the force flowing through the housing frame 22 through the slider unit 23 to the refractory base plate 25 to engage it against the head piece 42, as seen in FIG. 3. This force causes the refractory base plate 25 to be sealingly engaged with the end face 43 of the head piece 42 to ensure that no steel melt can flow out between the head piece 42 and the refractory plate 25, as well as between the refractory plate 25 and the sliding plate 26, when pouring.

The guide rails 52 are each provided with recesses 58 and 59, as illustrated in FIG. 2. At the ends of the guide ways 53 are further provided reduced height portions 53'. With these features, the housing frame 22 can be moved from its operational position so that the guide pegs 56' of the spring elements 56 move into the reduced height portions 53' in order to reduce the stress in the spring elements 56. The housing frame 22 can then be further moved to a release position, at which the support elements 54 and 55 on the housing frame 22 move into the recesses 58 and 59 between the guide rails 52. The housing frame 22 can then be removed from the vessel 10 by, for example, a crane or a stacker truck. The arrangement and the size of the recesses 58 and 59 are thus matched to the support elements 54 and 55.

Movement of the housing frame 22 can take place by moving the slider unit 23 in the sliding direction by a drive element (not shown in detail). With respect to the drive element that slides the housing frame 22, the same drive element that slides the slider unit 23 can be used for moving the housing frame 22, via the push rod 29. The housing frame 22 can, of course, also be slid in and out independently of the push rod 29.

Thus, when the housing frame 22 is removed, the slider unit is first slid to its indicated closed position 23'. It is then subsequently slid further in this closing direction, whereby the housing frame 22 moves with the slider unit 23 and is slid along the guide ways 53 until the spring elements 56 have their stress released by engaging the recesses 53'. When the lateral support elements 54 and 55 move into the recesses 58 and 59, the sliding valve 20 is then released from the vessel 10.

When mounting the housing frame 22 onto the vessel 10, the above-described procedure is carried out in reverse order, with the exception being that the slider unit 23 is first slid into its open position, and then pulls the housing frame 22 into its position on the guide ways 52.

As has been described above, according to a preferred feature of the present invention, the refractory base plate 25 is mounted in the housing frame 22 so as to be stationary in the direction of its planar surfaces, but to be movable in the direction perpendicular to its planar surfaces. In the above-described arrangement, this was accomplished by the elongate grooves 33 and the pegs 36 enabling the cassette 35 to move in the direction perpendicular to the planar surfaces of the refractory base plate 25. However, a variation is illustrated in FIG. 2, wherein the refractory base plate 25, held in the cassette 35, has respective cams 48 on both sides thereof. These cams 48 can be slid from the upper side of the housing frame 22 into respective open grooves 47 provided in the housing frame 22. By this arrangement, the cassette 35, and thus the refractory base plate 25, is then stationary or fixed in the direction of the sliding surface 28, but is movable perpendicularly thereto.

This feature of the present invention provides the advantage of the cassette being capable of being removed from the housing frame 22 without any accessories after the housing frame 22 has been removed from the metallurgical vessel 10, and likewise being reinserted into the housing frame 22 without any accessories.

Figure 4:
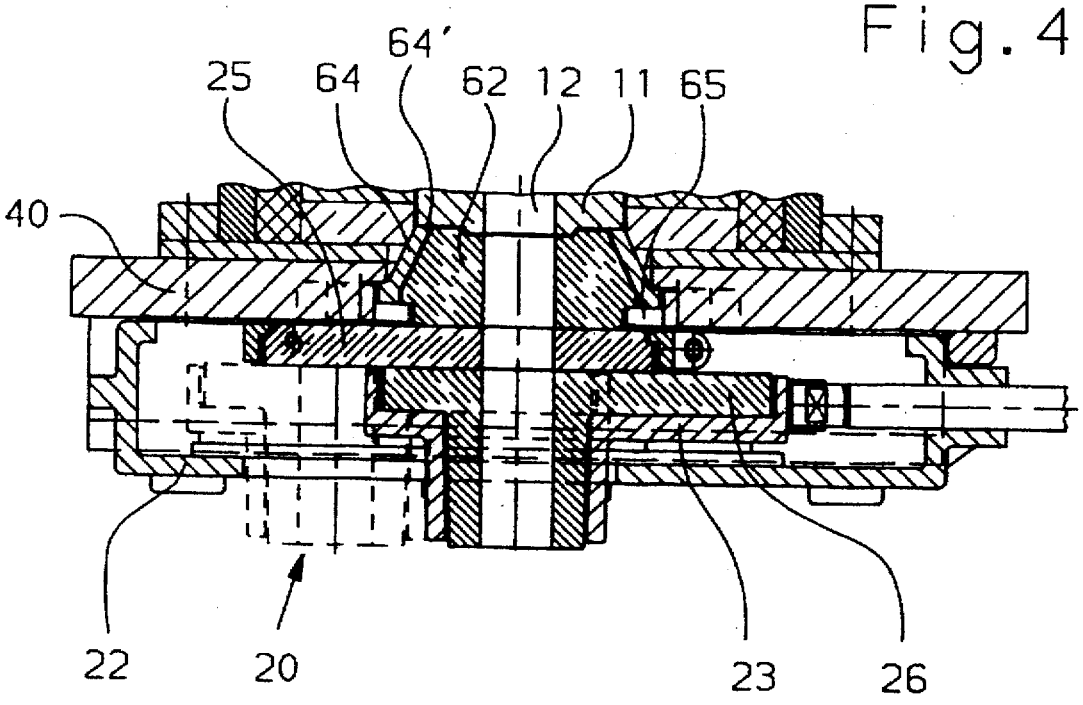
FIG. 4 is a longitudinal sectional view of a sliding gate valve in accordance with the present invention having a modified version of an outlet of a metallurgical vessel.

A variation of the head piece is illustrated in FIG. 4. As the arrangement of FIG. 4 is otherwise similar to FIG. 1, only the differences with respect to the head piece will be described.

The head piece 62 as shown in FIG. 4 is conical in shape on its outer periphery and is held in a correspondingly shaped ring 64. The ring 64 is metal and is removably connected to the adaptor plate 40 in a recess 65 of the adaptor plate 40 by any appropriate fastening mechanism. The ring 64 has an abutment 64' on its upper end face, which abutment is engaged by the discharge sleeve 11. The discharge sleeve 11 is thereby prevented from expanding toward the head piece 62 during operation. The head piece 62 of this embodiment, similar to the above embodiment, has a flat sliding surface on its underside engaged by the plane sliding surface of the refractory base plate 25.

The present invention has been described above with respect to the preferred illustrated embodiments. It should be noted, however, that the sliding gate valve according to the present invention is not only usable with a convertor, but also with a ladle used with continuing casting installations, or with a distributor vessel.

The specific features of the present invention as discussed above are not to be taken in a limiting manner, as variations will occur to those of skill in the art. Rather, the scope of the present invention is defined by the appended claims.

We claim:

1. A sliding gate valve for a metallurgical vessel, comprising:

a metallurgical vessel comprising a refractory headpiece and a vessel outlet at said refractory headpiece;

a housing frame mounted to said vessel at said vessel outlet so as to be removable from said vessel;

a slider unit mounted in said housing frame so as to be slidable in a longitudinal direction of said housing frame, said slider unit having a sliding plate therein;

a refractory base plate having an upper side with a plane sliding surface engaged with said refractory headpiece and a lower side with a lower sliding surface parallel to said plane sliding surface, said refractory base plate being mounted in said housing frame such that:

said sliding plate is pressed against said lower sling surface of said refractory base plate, and said refractory base plate is fixed in said housing frame in a direction parallel to said sling surfaces of said refractory base plate but movable in said housing frame in a direction perpendicular to said sliding surfaces of said refractory base plate; and spring elements biasing said sliding plate against said lower sliding surface of said refractory base plate;

wherein guide rails are mounted to said metallurgical vessel so as to extend transversely with respect to said outlet, said housing frame being mounted on said guide rails so as to be slidable thereon between a mounting and release position and an operational position.

2. The sliding gate valve of claim 1, wherein:

said guide rails comprise two parallel L-shaped guide rails that each define an inner guide way;

each of said two parallel L-shaped guide rails has a reduced height portion thereon adjacent to said mounting and release position; and said spring elements are located so as to act between said L-shaped guide rails and said housing frame, said spring elements being engageable with said reduced height portions in order to reduce stress on said spring elements.

3. The sliding gate valve of claim 1, wherein:

said housing frame comprises a plurality of support elements thereon along sides thereof engaging said guide rails in order to support said housing frame; and said guide rails have recesses therein corresponding to said support elements, whereby said mounting and release position corresponds to said support elements of said housing frame being located at said recesses.

4. The sliding gate valve of claim 3, wherein:

said guide rails comprise two parallel L-shaped guide rails that each define an inner guide way;

each of said two parallel L-shaped guide rail has a reduced height portion thereon adjacent to said mounting and release position; and said spring elements are located so as to act between said L-shaped guide rails said housing frame, said spring elements being engageable with said reduced height portions in order to reduce stress on said spring elements.

5. The sliding gate valve of claim 1, wherein:

said metallurgical vessel has an adapter plate thereon, said headpiece being mounted in said adapter plate; and said refractory headpiece has a lower flat end surface against which said plane sliding surface of said refractory base plate is pressed.

6. The sliding gate valve of claim 1, wherein:

said refractory base plate is mounted in a cassette;

said cassette is mounted in said housing frame by a mounting connection that mounts said cassette so as to be fixed in said housing frame in a direction parallel to said sliding surfaces of said refractory base plate but so as to be movable in said housing frame in a direction perpendicular to said sliding surfaces of said refractory base plate.

7. The sliding gate valve of claim 6, wherein said mounting connection comprises elongate grooves located on one of said cassette and said housing frame that extend in a direction perpendicular to said sliding surfaces of said refractory base plate and pegs located on the other of said cassette and said housing frame engaging in said elongate grooves.

8. The sliding gate valve of claim 6, wherein said mounting connection comprises cams on opposite sides of said cassette and open grooves on said housing frame, said cams being engaged with said open grooves.

9. A sliding gate valve for a metallurgical vessel, comprising:

a metallurgical vessel comprising a refractory headpiece and a vessel outlet at said refractory headpiece;

a housing frame mounted to said vessel at said vessel outlet so as to be removable from said vessel;

a slider unit mounted in said housing frame so as to be slidable in a longitudinal direction of said housing frame, said slider unit having a sliding plate therein;

a refractory base plate having an upper side with a plane sliding surface engaged with said refractory headpiece and a lower side with a lower sliding surface parallel to said plane sliding surface, said refractory base plate being mounted in said housing frame such that:

said sliding plate is pressed against said lower sling surface of said refractory base plate, and said refractory base plate is fixed in said housing frame in a direction parallel to said sling surfaces of said refractory base plate but movable in said housing frame in a direction perpendicular to said sliding surfaces of said refractory base plate; and spring elements biasing said sliding plate against said lower sliding surface of said refractory base plate;

wherein said metallurgical vessel has an adapter plate thereon and a ring releasably mounted in said adapter plate, said ring having an end with an abutment;

said refractory headpiece is positioned in said ring; and a refractory discharge sleeve extends from said ring in to said metallurgical vessel, said discharge sleeve being located adjacent to said abutment of said ring.

10. The sliding gate valve of claim 1, wherein:

said refractory headpiece has an annular shape, has an opening extending through said headpiece in an opening direction and has a lower flat end surface extending transversely to the opening direction and serving as a sliding surface against which said plane sliding surface of said refractory base plate is pressed and can be slid.

11. A sliding gate valve for a metallurgical vessel, comprising:

a metallurgical vessel comprising a refractory headpiece and a vessel outlet at said refractory headpiece;

a housing frame mounted to said vessel at said vessel outlet so as to be removable from said vessel;

a slider unit mounted in said housing frame so as to be slidable in a longitudinal direction of said housing frame, said slider unit having a sliding plate therein;

a refractory base plate having an upper side with a plane sliding surface engaged with said refractory headpiece and a lower side with a lower sliding surface parallel to said plane sliding surface, said refractory base plate being mounted in said housing frame such that:

said sliding plate is pressed against said lower sling surface of said refractory base plate, and said refractory base plate is fixed in said housing frame in a direction parallel to said sling surfaces of said refractory base plate but movable in said housing frame in a direction perpendicular to said sliding surfaces of said refractory base plate; and spring elements biasing said sliding plate against said lower sliding surface of said refractory base plate;

wherein said refractory headpiece has an annular shape, has an opening extending through said headpiece in an opening direction and has a lower flat end surface extending transversely to the opening direction and serving as a sliding surface against which said plane sliding surface of said refractory base plate is pressed and can be slid; and wherein said refractory headpiece has a connecting flange thereon and said metallurgical vessel has an adapter plate thereon and a mechanism mounting said refractory headpiece to said adapter plate by said connecting flange.

12. The sliding gate valve of claim 1, wherein:

said housing frame comprises guide rails thereon supporting said slider unit for sliding movement thereon in the longitudinal direction;

said refractory base plate is mounted in a cassette, and said cassette is connected to said housing frame by a mounting connection that mounts said cassette so as to be fixed in said housing frame in a direction parallel to said sliding surfaces of said refractory base plate but so as to be movable in said housing frame in a direction perpendicular to said sliding surfaces of said refractory base plate; and said sliding plate has an upper sliding surface slidable against said lower sliding surface of said refractory base plate.

13. A sliding gate valve assembly for use with a metallurgical vessel, comprising:

a housing frame adapted to be mounted to a metallurgical vessel at a vessel outlet so as to be removable from the vessel;

a slider unit mounted in said housing frame so as to be slidable in a longitudinal direction of said housing frame, said slider unit having a sliding plate therein;

a refractory base plate having an upper side with a plane sliding surface capable of being engaged with a refractory headpiece of the vessel and a lower side with a lower sliding surface parallel to said plane sliding surface, said refractory base plate being mounted in said housing frame such that:

said sliding plate is against said lower sliding surface of said refractory base plate, and said refractory base plate is fixed in said housing frame in a direction parallel to said sliding surfaces of said refractory base plate but movable in said housing frame in a direction perpendicular to said sliding surfaces of said refractory base plate;

wherein said housing frame comprises a plurality of support elements thereon along sides thereof adapted to support said housing frame on the vessel; and wherein spring elements are located on said support elements of said housing frame.

14. The sliding gate valve assembly of claim 13, wherein:

said refractory base plate is mounted in a cassette;

said cassette is mounted in said housing frame by a mounting connection that mounts said cassette so as to be fixed in said housing frame in a direction parallel to said sliding surfaces of said refractory base plate but so as to be movable in said housing frame in a direction perpendicular to said sliding surfaces of said refractory base plate.

15. The sliding gate valve assembly of claim 14, wherein said mounting connection comprises elongate grooves located on one of said cassette and said housing frame that extend in a direction perpendicular to said sliding surfaces of said refractory base plate and pegs located on the other of said cassette and said housing frame engaging in said elongate grooves.

16. The sliding gate valve assembly of claim 14, wherein said mounting connection comprises cams on opposite sides of said cassette and open grooves on said housing frame, said cams being engaged with said open grooves.

17. The sliding gate valve assembly of claim 13, wherein:

said housing frame comprises guide rails thereon supporting said slider unit for sliding movement thereon in the longitudinal direction;

said refractory base plate is mounted in a cassette, and said cassette is connected to said housing frame by a mounting connection that mounts said cassette so as to be fixed in said housing frame in a direction parallel to said sliding surfaces of said refractory base plate but so as to be movable in said housing frame in a direction perpendicular to said sliding surfaces of said refractory base plate; and said sliding plate has an upper sliding surface slidable against said lower sliding surface of said refractory base plate.

18. A refractory headpiece for use with a sliding gate valve for a metallurgical vessel that comprises a vessel outlet, a housing frame mounted to the vessel at the vessel outlet so as to be removable from the vessel, a slider unit mounted in the housing frame so as to be slidable in a longitudinal direction of the housing frame, the slider unit having a sliding plate therein, a refractory base plate having an upper side with a plane sliding surface and a lower side with a lower sliding surface parallel to the plane sliding surface, the refractory base plate being mounted in the housing frame such that the sliding plate is pressed against the lower sliding surface of the refractory base plate, and the refractory base plate is fixed in the housing frame in a direction parallel to the sliding surfaces of the refractory base plate but movable in the housing frame in a direction perpendicular to the sliding surfaces of the refractory base plate, and spring elements biasing the sliding plate against the lower sliding surface of the refractory base plate, said refractory headpiece comprising:

an annular body adapted to be mounted at the vessel outlet, said annular body having a flow passage extending therethrough and a flat end surface that extends transversely to said flow passage, said flat end surface defining a sliding surface for sliding engagement with the plane sliding surface of the refractory base plate.

19. The refractory headpiece of claim 18, wherein said annular body has a connecting flange thereon, the metallurgical vessel having an adapter plate thereon and a mechanism adapted to mount said refractory headpiece to the adapter plate with said connecting flange.

20. The refractory headpiece of claim 19, wherein said connecting flange has an engagement surface facing in the same direction as said sliding surface for engagement by the mechanism.

21. The refractory headpiece of claim 18, wherein said annular body has a side opposite to said sliding surface adapted to engage an inlet sleeve of the vessel outlet.

22. The refractory headpiece of claim 18, wherein said annular body has a metal ring mounted thereon.

23. The refractory headpiece of claim 22, wherein said annular body has a connecting flange thereon and an upper end for engagement with an inlet sleeve of the vessel outlet, said metal ring extending around said annular body from said connecting flange to said upper end.

24. The refractory headpiece of claim 23, wherein said metal ring has an abutment on an upper end face thereof for engagement with the inlet sleeve.

25. The refractory headpiece of claim 22, wherein said annular body tapers toward an upper end.

26. The refractory headpiece of claim 25, wherein said outer tapered surface is covered by a metal ring.

* * * * *